United States Patent [19]

Holt

[11] Patent Number: 4,479,480

[45] Date of Patent: Oct. 30, 1984

[54] CROSSBOW TRIGGER MECHANISM

[76] Inventor: Zedoc A. Holt, 2125 Brookhurst Ave., Columbus, Ohio 43229

[21] Appl. No.: 428,203

[22] Filed: Sep. 29, 1982

[51] Int. Cl.[3] ..... F41B 5/00

[52] U.S. Cl. ..... 124/35 R

[58] Field of Search ..... 124/25, 35 R, 35 A, 124/18, 26, 27

[56] References Cited

U.S. PATENT DOCUMENTS

| | | | |
|---|---|---|---|
| 1,469,610 | 10/1923 | Ustynik | 124/18 |
| 2,842,114 | 7/1958 | Duncan | 124/25 |
| 4,004,564 | 1/1977 | Castonguay | 124/35 A |
| 4,192,281 | 3/1980 | King | 124/25 |

*Primary Examiner*—Richard J. Apley
*Assistant Examiner*—William R. Browne

[57] ABSTRACT

A crossbow trigger mechanism is provided having three mechanically operable lever elements designated as a string holding cylinder, trigger lever and a locking lever. These three lever elements are mounted for pivotable rotation in a substantially common plane about parallel axes. Their axes are relatively positioned such that a mechanical interlock is formed between the cylinder and trigger lever when the cylinder is in a string holding position to prevent release of a string and between the trigger lever and locking lever when the locking lever is in a locking position with respect to the trigger lever to prevent the trigger lever from being moved. A torsion spring is provided and interconnected between the locking lever and trigger lever to provide a biasing force for rotation of the locking lever in either direction dependent upon whether the lever is in a locked position or an unlocked position. The cylinder and locking lever are positioned and mutually configured to cooperatively interengage during rotation of the cylinder in release of a bowstring to initiate return of the locking lever to its locked position. The torsion spring completes return of the locking lever to its locked position when a bowstring is again placed in restrained relationship on the string holding cylinder or by revolving the cylinder to its string holding position as an automatic consequence of that cocking operation.

21 Claims, 8 Drawing Figures

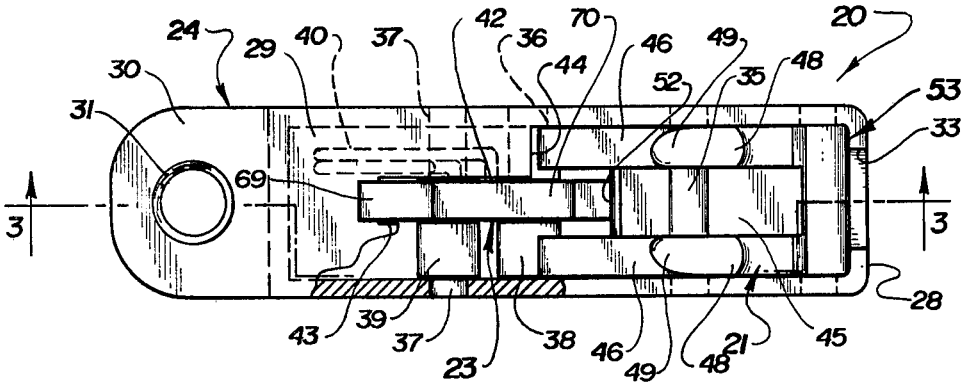
Fig. 2
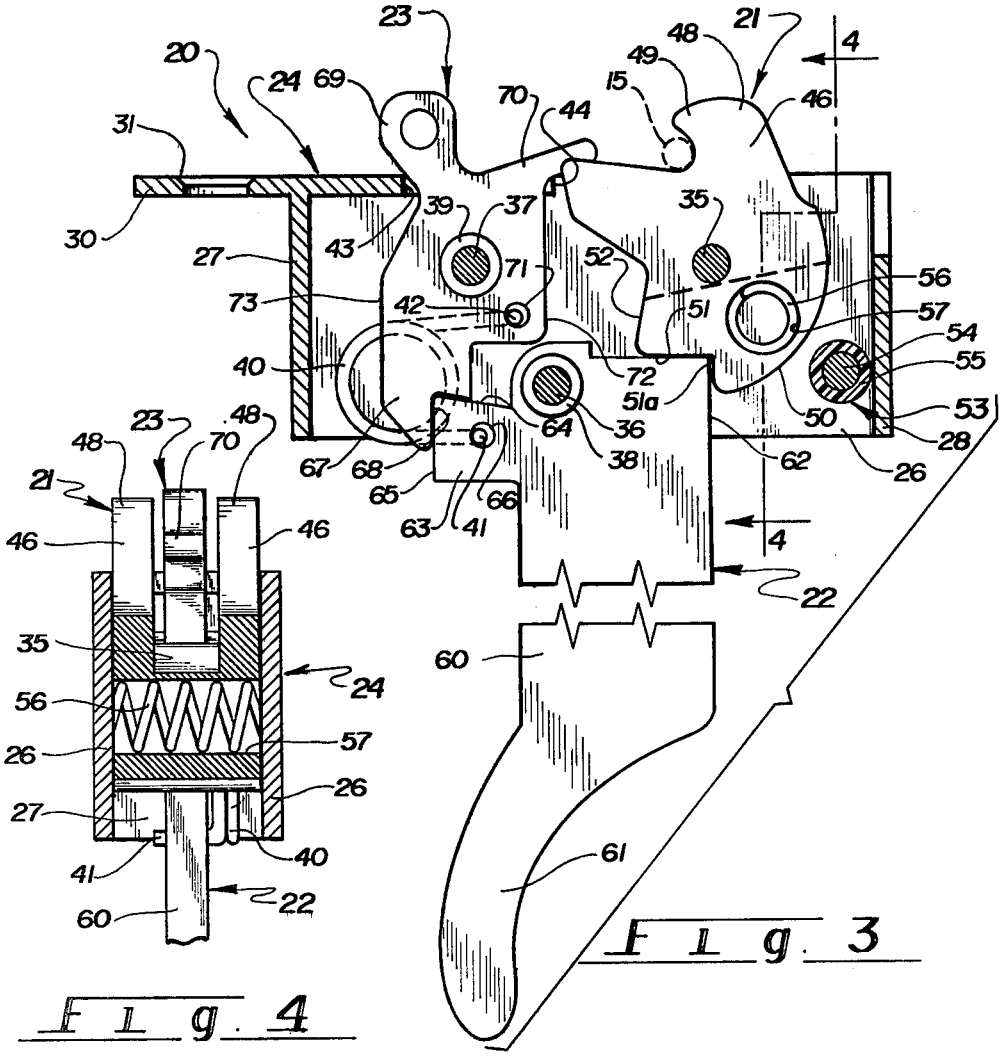
Fig. 3
Fig. 4

CROSSBOW TRIGGER MECHANISM

FIELD OF THE INVENTION

This invention relates, in general, to the field of crossbows designed for the propelling of a projectile such as a bolt or arrow for hunting or target practice. The invention relates more particularly to a trigger mechanism for the retention and selective release of a bowstring that is adapted to engage with the projectile for effecting the propulsion of that projectile.

BACKGROUND OF THE INVENTION

Crossbows embodying the general and well-known constructional principles of a bow mounted on a supporting stock have recently become more widely utilized. Crossbows are now more frequently utilized for purposes of hunting game animals in addition to being used for competition matches by their enthusiasts.

As indicated, crossbow, in its general construction, includes a generally conventional bow which is mounted upon and carried on a supporting structure generally characterized as a gunstock and its associated forearm. The bow includes a strong resilient limb or set of limbs secured to a forward portion of the stock and forearm and has a string adapted to engage with a projectile such as a bolt or an arrow. Also included in the structure of crossbow is a trigger mechanism which has the appearance of a trigger for conventional firearms and is operable for a same general purpose. However, in a crossbow, the trigger mechanism, rather than operating upon a firing pin, includes a mechanism designed for engaging with and retaining the bowstring in a cocked position where it is able to then impart the necessary force for propulsion of the projectile. The stock and forearm often provide means of initial guidance for the projectile to enhance the accuracy of the crossbow. The trigger mechanism, in general, includes a device which forms a stop element around which the bowstring is strung when cocked and this element then is permitted to move to a position where the string is released upon actuation of the trigger and enable functional operation of the crossbow.

Safety in the operation of a crossbow has become a matter of great importance due to the increased number of crossbow enthusiasts and their increasing usage. A crossbow, in its basic construction, has an inherent safety problem in that trigger mechanisms designed to operate in the desired manner can be very easily caused to inadvertently function and release the bowstring. Consequently, efforts have been made to construct trigger mechanisms to incorporate a sefety device or mechanism to better assure that the mechanism can be maintained in an operating state that will prevent inadvertent or accidental functioning of the trigger to release the string holding element of the mechanism. The safety devices, in general, comprise a structure incorporating a locking lever or element which cooperates with the trigger so as to maintain the trigger in a position that will retain the string holding element in its holding position until such time as the safety element is released or is moved to an arming position with respect to the trigger. It is also a desired constructional feature of trigger mechanisms incorporating safety mechanism to have the mechanism operate in an essentially automatic manner during the operation of cocking of the string so that upon positioning of the string holding element in its string holding position, the trigger would not only be in a position to retain the string holding element in that position, but the safety device will also be operated to place it in a position where it will function to prevent operation of the trigger.

Exemplary of prior structures designed to accomplish these general objectives is the mechanism disclosed in U.S. Pat. No. 3,490,429 issued Jan. 20, 1972 to D. S. Benedict. That mechanism includes a string holding element in the form of a device mounted for rotational movement between a string holding and a string releasing position and a trigger which cooperates with the string holding element to lock it in a string holding position. A safety device in the form of a rotatable cam shaft is positioned to cooperate with the trigger. This cam shaft has a surface configuration such that, depending upon the particular position to which it is rotated, it will either engage the trigger to prevent its movement out of locking engagement with the string holding element or will permit slight rotational movement of the trigger to permit functioning with consequent release of the bowstring. The safety device is provided with a spring which continually urges the safety element to a safetying position by causing rotation of the cam shaft to a trigger locking position. A disadvantage of this structure is that, in order to permit operation of the trigger mechanism, the operator must also maintain the safety element in the nonsafetying position while concurrently and simultaneously operating the trigger member. This structure, however, does have a structure capable of achieving the desired objective of placing the safety in a safetying position automatically upon cocking of the bowstring.

Another example of a structure for an automatically functioning safety in a crossbow trigger mechanism is that shown in U.S. Pat. No. 4,030,473 granted June 21, 1977 to John W. Puryear. This structure also includes the three basic elements of a string holding element, trigger lever and a safety locking device. The elements are arranged in such a manner that, during the cocking operation as the string is drawn into the string holding element, the string will also concurrently cooperate in engagement with the locking element so as to effect displacement of the locking element into a locked position in association with the trigger. The disadvantage of the particular structure as shown in U.S. Pat. No. 4,030,473 is that the cocking operation, so as to effect the setting of the safety, requires a greater displacement of the string than is actually required to place the string in a cocked position.

A third example of a structure intended to achieve the objective of automatic setting of a safety device on a trigger mechanism for a crossbow is illustrated in U.S. Pat. No. 4,192,281 granted Mar. 11, 1980 to Fred V. King. The structure shown in this patent for a trigger mechanism is similar to the basic trigger mechanism for crossbows and in addition, operates in a similar manner to that of U.S. Pat. No. 4,030,473. In U.S. Pat. No. 4,192,281, the structure includes a string holding element which is rotatable about a pivot axis and is held in a storing holding position by a trigger lever. A safety lever is provided which operates on the trigger lever to maintain it in a locked position until selectively displaced to an unlocking position. The function of this mechanism is similar to that of Puryear in that cocking of the bow by drawing the string to a cocked position requires that the string must be moved a greater distance than when ultimately placed in its held position to effect operation of the safety lever.

U.S. Pat. No. 3,924,599 issued Dec. 9, 1975 to William D. Hammond illustrates a trigger mechanism for a compressed-air gun which is non-analogous to the crossbow art, but is nevertheless deemed relevant with respect to illustrating a spring mechanism interconnected with a safety or locking lever and a trigger lever. The trigger lever shown in that patent disclosure comprises two elements that are separately mounted for pivotal movement, but are mechanically interconnected for cooperative movement to either hold or release a spring device that generates the projectile propelling energy. The safety lever is always biased to a safety position by the spring interconnecting with the trigger lever and which spring concurrently biases the trigger lever to the hold position. A cocking operation temporarily displaces the safety lever to its unsafe position in order to enable cocking of the gun. An examination of the pivot and fulcrum points of the safety lever and the biasing spring shows that this mechanism is also of the type requiring that the safety lever be simultaneously held in the unsafe position while pulling the trigger.

SUMMARY OF THE INVENTION

The trigger mechanism for a crossbow and embodying this invention includes the three basic elements of a string holding element, trigger lever and a safety or locking lever which are designed to cooperate in a manner whereby the safety or locking lever will automatically function to be placed in locking interengagement with the trigger lever upon cocking of the bow string. Movement of the locking lever in the trigger mechanism of this invention to its locking position does not depend directly upon movement of the bowstring during a cocking operation. The string holding element does initiate the automatic locking function by placing the locking lever in a position where the locking can be accomplished automatically without direct dependence upon the operation of either the string holding element or movement of the bowstring during a cocking operation. This is accomplished by a resilient spring element which interconnects between the locking lever and trigger lever to not only maintain the locking lever in either a lock position or an unlock position with respect to the trigger, but to effect the displacement of the locking lever to its lock position with respect to the trigger.

The basic mechanical structure of the trigger mechanism provided by this invention includes a string holding element in the form of a cylinder as rotatable upon an axis and has a notch formed therein for engaging with the bow string. The string holding cylinder includes a latch detent formed on a surface thereof for effecting cooperating mechanical interengagement with a trigger lever when in a cocked position. The arrangement of the trigger lever and its pivot with respect to the string holding cylinder and its pivot with respect to the dimensional configuration thereof, is such that the tension applied by the string will maintain the two elements in a locking engagement. The point of interengagement of the trigger lever and cylinder is of a position relative to the pivot of the trigger lever so that the bowstring force will be effective in maintaining these elements in latched engagement. As is the case with mechanisms of this type, rotational movement of the trigger lever will result in disengagement from the string holding cylinder to permit its rotation and consequent release of the bowstring during a firing operation. Selective locking of the trigger in engagement with the string holding cylinder when the bow is cocked, is effected by a locking lever also mounted for rotational movement about an axis. The locking lever is formed with a latch detent that cooperates with an element of the trigger lever to prevent its rotation in a direction permitting disengagement of the trigger lever from the string holding cylinder. The configuration and mechanical dimensions of the locking lever and trigger lever are such that there is a positive mechanical lock to prevent the rotation of the trigger lever until such time as the locking lever is manually displaced to an unlocked or unsafe position. Each of the locking and trigger levers are formed with interengaging conformations such that a camming action occurs when pressure is applied to operate the trigger to effectively enhance the interlocking of the locking and trigger levers. Interconnecting the locking lever and trigger lever is a torsion spring that is interconnected between the two components in dimensional relationship so as to function as an over-center type of toggle mechanism. The torsion spring is interconnected to these two components at relative positions with respect to their points of pivoting such that when the trigger lever is in latched engagement with the string holding cylinder, the trigger lever forms a rigid base against which the torsion spring operates and causes the locking lever to be urged toward a locking position. The position is such that when the locking lever is manually pivoted to an unsafe position and out of latched engagemnt with the trigger lever, the torsion spring then functions to maintain the locking lever in this unsafe position with respect to the trigger lever.

Automatic functioning of this trigger mechanism to place the locking lever in its safety position during a cocking operation is initiated by the rotational movement of the string holding cylinder during a string releasing movement. During the rotational movement of the string holding cylinder in the process of releasing the bowstring, the cylinder will mechanically engage with the locking lever to displace it to an intermediate position as between its lock and unlocked positions with respect to the trigger lever whereby the torsion spring will subsequently be capable of causing continued rotation of the locking lever to its locked position during a subsequent string cocking operation. This completing of the displacement of the locking lever to a locked position is a function of the over-center toggle interconnection of the torsion spring as between the locking lever and trigger lever.

The trigger mechanism of this invention is of a relatively simple mechanical construction having a safety or locking feature which is automatically reset at any time that the bowstring is again cocked by placing it into a holding position on the string holding cylinder. The functioning of the locking lever is fully automatic and independent of any mechanical relationship to the bowstring itself and thus has the advantage that the operator need only concentrate on the string cocking function itself with respect to the string holding cylinder. The operator, by merely drawing the string into cocking engagement with the cylinder, or by first placing the cylinder in its cocked position enables the other components of the mechanism to automatically function to place the trigger lever into latched engagement with the string holding cylinder and causing automatic movement of the locking lever to a latched position with respect to the trigger lever.

These and other objects and advantages of this invention will be readily apparent from the following detailed description of an illustrative embodiment thereof and by reference to the accompanying drawings.

DESCRIPTION OF THE DRAWING FIGURES

FIG. 2 is a top plan view of the trigger mechanism.

FIG. 3 is a vertical sectional view taken along line 3—3 of FIG. 2.

FIG. 4 is a transverse sectional view taken along line 4—4 of FIG. 3.

DESCRIPTION OF THE ILLUSTRATIVE EMBODIMENT

Figure 1:
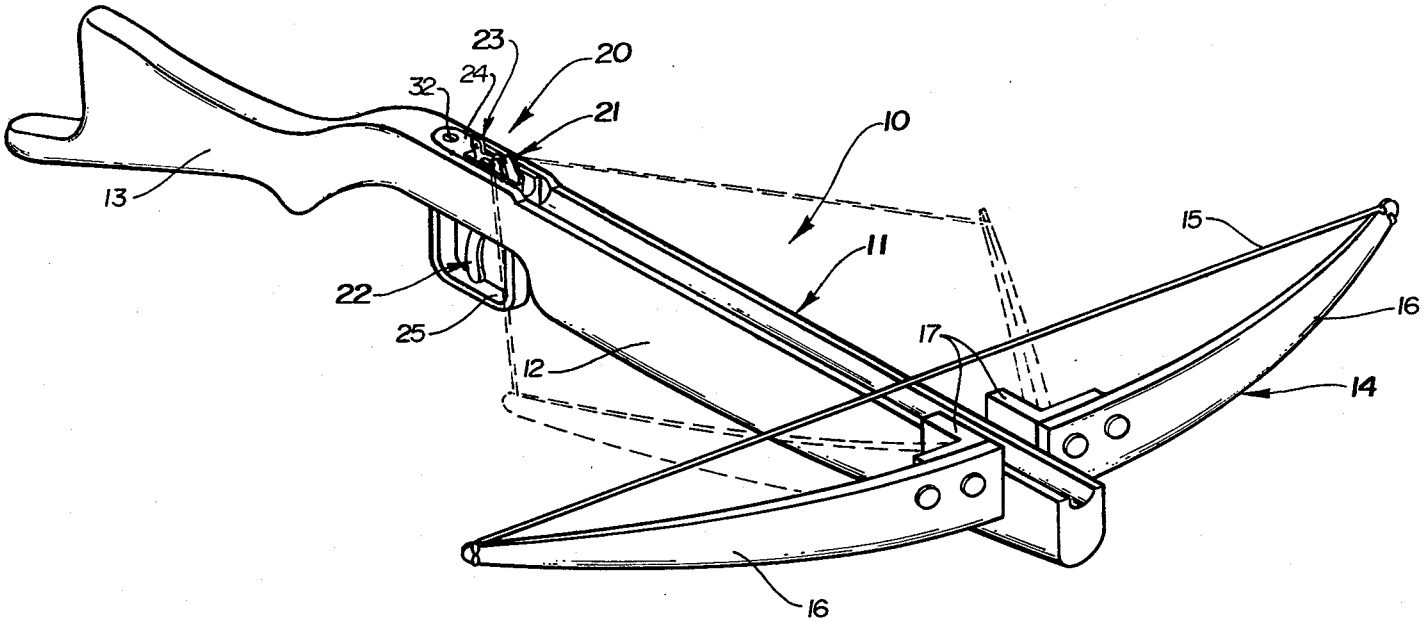
FIG. 1 is a perspective view of a crossbow provided with a trigger mechanism embodying this invention.

Referring specifically to FIG. 1 of the drawings, it will be seen that a crossbow 10 is illustrated and incorporates the generally known constructional features. This crossbow includes a supporting stock 11 having a forearm 12 and a rear shoulder stock portion 13. The stock 11 may be formed from a suitable wood in an integral structure and carries at its forward end a bow 14 having a bowstring 15 secured thereto. The bow 14 in this illustrative embodiment is formed in two sections with each bow limb 16 secured to a respective mounting bracket 17 that is, in turn, secured to the forearm 12. It will also be noted that the forearm 12 has formed on its upper side a longitudinally extending slot 18 which is designed to function as a guide in initially directing the path of movement of the projectile. The projectile in this instance is not illustrated as the structures are of a conventional and well-known nature which may be either a steel bolt or an arrow having fletching at one end and a knock for engaging with the bowstring.

A trigger mechanism 20 is provided and is mounted on the stock 11 at the juncture of the shoulder stock 13 and forearm 12. The trigger mechanism of this invention, in general, includes a string holding cylinder 21, a trigger lever 22 and a safety or locking lever 23. These three components are mounted in a supporting frame 24 forming an assembly which is positioned within a receiving socket formed in the stock 11. The string holding cylinder 21 is thus located at the top of the stock along with the locking lever 23 with a portion of the trigger lever 22 projecting in downwardly extending relationship to the stock. A guard 25 is also advantageously provided for the trigger lever and is secured to the stock in a conventional manner and positioned to permit operation of the trigger lever. As can be seen in FIG. 1, the string holding cylinder 21 is operable to project in upstanding relationship to the upper surface of the stock and is adapted to engage with the bowstring 15. Placement of the bowstring in a cocked position is illustrated by the broken line representation of the bowstring extending around the rearwardly facing side of the upstanding portions of the string holding cylinder.

Structural specifics of the trigger mechanism are illustrated on a substantially enlarged scale in FIGS. 2, 3 and 4 of the drawings. As can be best seen in these drawing figures, the supporting frame 24 is in the form of a rectangularly shaped case that opens at the top and at the bottom for outward projection of respective components from the interior thereof. The frame 24 includes a pair of vertically disposed, longitudinally extending side walls 26 that are interconnected at their opposite ends by respective end walls 27 and 28. These walls of the frame are preferably formed from a material such as steel which has adequate structural strength for a structure of this type. A partial top plate 29 is also provided for covering of a portion of the upper end of the supporting frame. The top plate 29 is formed with or welded to the side walls and includes an end portion 30 which projects a distance longitudinally with respect to the end wall 27. Formed in this end portion 30 is a countersunk aperture 31 adapted to receive a fastening device such as a wood screw 32 that can be threaded into the stock 11 for securing of the trigger mechanism to the stock. A U-shaped notch 33 is formed in the forward end wall 28 and opens at the upper or top edge of that wall. This notch provides additional clearance for passage of the feather or fletching elements of a conventional arrow through the notch during discharge of the arrow from the mechanism as well as to better accommodate the bolt or the arrow itself.

Disposed between the spaced apart side walls 26 of the frame are the three operating elements of the trigger mechanism. Each of the string holding cylinder 21, trigger lever 22 and safety or locking lever 23 are supported on respective pivots for rotational movement in a generally common vertical plane that extends longitudinally of the frame. Each of these three operating elements is supported on its respective axle 35, 36 and 37 with these axles extending horizontally across the supporting frame with the opposite ends of each axle being disposed in respective sockets that are formed in the side walls 26.

The string holding cylinder 21 has a transverse dimension which is substantially equal to that of the spacing of the interior surfaces of the side walls 26 and is thus retained in a proper position during rotational movement by those side walls. Each of the trigger lever 22 and locking lever 23 are of plate-form and relatively narrower than the space between the side walls 26 and thus spacing elements are provided to maintain those levers in centrally aligned relationship within the frame and between the side walls. These spacing elements in this illustrative embodiment are formed by respective spacing tubes 38 and 39 that are mounted on the respective axles 36 and 37 with a tube being placed at each side of the respective element. These tubes 38 and 39 have end surfaces that thus bear against the respective surfaces of the trigger lever or locking lever and the adjacent interior surface of the respective side wall 26.

Automatic functioning of the components and specifically functioning of the locking lever 23 is effected in the structure of this invention by spring means 40. This spring means is fabricated in the form of a torsion spring comprising a plural loop, main body section formed from an elongated, resilient spring wire having the opposite ends thereof formed into connecting loops 41 and 42. These connecting loops 41 and 42, as will be subsequently described, are adapted to mechanically interconnect with the respective ones of the trigger lever 22 and locking lever 23 with the point of connection with the trigger lever forming a fulcrum point for its operation. It is preferred that a single spring be used to minimize the number of components although separate springs could be used to bias each of the trigger and locking levers and biasing of the trigger lever to its latched position could be omitted, although such omission would make the device less safe in its operation.

The top plate 29 extends partially over the top of the frame 24, and thus, provides protection relative to a major portion of the working components with only the string holding cylinder 21 being fully exposed from the top. Since it is necessary that the locking lever 23 be exposed and be able to project above the top of the frame, the plate is formed with a longitudinally extending slot 43 through which the locking lever 23 may swing in its rotational movement. The slot 43 is open at an edge 44 of the plate located at substantially the midpoint of the frame and thus leaves an open area at the top which is sufficient to permit projection and rotational movement of the string holding cylinder 21.

Considering the specific structure of the string holding cylinder 21, it will be seen that this element comprises a generally U-shaped, integrally formed structure having a center web 45 interconnecting two spaced apart flanges or side plates 46. Each of the side plates 46 extends vertically with respect to the frame 24 and has a side surface that is disposed adjacent and in contact with a respective interior surface of the frame's side walls 26. The flanges cooperatively define a space therebetween that is sufficient to receive the end portion of an arrow and permit an arrow or bolt to project therethrough into engagement with a bowstring held by the lugs. Formed in each of the side plates 46 is a generally V-shaped notch 47 specifically configured to cooperatively interengage with the bowstring 15. One side of the notch 47 is defined by a lug 48 integrally formed with each respective flange 46 and having arcuately curved surfaces 49 designed to engage with the string and avoid any sharp bend in the string. A forwardly facing edge surface of each of the plates 46 is arcuately curved to define a generally cylindrical cam surface 50 which also incorporates a contiguous surface portion of the center web 45. Also formed in the exterior edge surfaces of the side plates 46 is a trigger latching recess 51 having an L-shaped configuration and which also includes contiguous portions of the center web 45. A portion of the surface of the center web 45 disposed between the side plates 46 is configured to form a cam surface 52 designed to cooperate with the locking lever 23 in performing the automatic resetting functions of the trigger mechanism. A transversely extending bore is formed in the cylinder for receiving the supporting axle 35 upon which the cylinder is mounted for rotation.

Limitation as to rotation of the cylinder 21 in a clockwise direction as viewed in FIG. 3 is provided by a stop element 53. This stop element includes a pin 54 that extends transversely across the frame and is supported at each of its opposite ends in respective sockets formed in the frame side walls 26. This pin 54 is located in spaced parallel relationship to the axle 35 so as to be in the path of movement of the lugs 48 as they revolve in a clockwise direction. Thus, when the cylinder revolves, the forwardly facing edge surfaces of the lug will be brought into contacting engagement with the stop element. To cushion the cylinder and to also reduce the noise that would otherwise be effected by contacting metallic components, the pin 54 is advantageously provided with an exterior cylindrical sheath 55 of resilient material such as a suitable rubber.

It is also preferred that the string holding cylinder 21 be designed so that it will frictionally engage with the frame and thus tend to remain in an attained position and not revolve freely in response to its own weight or momentum. This is accomplished through the provision of a drag spring 56 which comprises a helically coiled spring. The spring 56 is disposed in a cylindrical socket 57 that is formed in the cylinder and opens at the outer surfaces of each of the respective side plates 46. The opposite ends of the spring 56 which is of an appropriate length are projected into contacting engagement with respective interior surfaces of the side walls 26 and the spring is capable of exerting sufficient force to produce the desired frictional resistance to rotation of the cylinder, but not so great as to materially inhibit rotation upon applying an external revolving force to the cylinder. Frictional forces thus generated by the spring 56 are effective in preventing the cylinder from merely rotating freely once it has been released from locking engagement with the trigger lever 22. In operation of the trigger mechanism, release of the cylinder 21 with a bowstring positioned in the notch 47 will normally result in the cylinder being rapidly revolved into contacting engagement with the stop element 53 and the drag spring 56 then functioning to prevent or retard reverse rotation as a consequence of the resilient effect of its contact with the cushioning rubber cylinder 55.

The trigger lever 22 is formed from a structurally rigid plate having an elongated body which is journalled at one end on its axle 36. Integrally formed with the main body 60 and extending in longitudinal relationship at the end opposite the axle 36 is an arcuately curved finger grip 61. provided at an end of the main body 60 adjacent to the axle journal is a latch surface 62 formed as an L-shaped corner of the main body. This latch surface 62 is designed to mechanically interengage with the latching recess 51 that is formed in the string holding cylinder 21 and which recess has a relatively short, generally vertically oriented contact surface 51a to minimie trigger travel for unlatchin. Referring to FIG. 3, it will be noted that the axles 35 and 36 for the respective components are located in spaced apart relationship so that the cylinder 21 and the trigger lever form a mechanical lock when interengaged as shown in FIG. 3 with a string 15 positioned in the V-shaped notch 47 as at the conclusion of a cocking operation. The cylinder and trigger thus resist the release of the string in that their paths of movement relative to the latching recess 51 and the latch surface 62 describe interfering paths and the cylinder and trigger lever are thus prevented from further rotation because of the mutual interfering relationship. It will also be noted that the point of interengagement of the latch surface 62 with the latch recess 51 occurs at a point which is above a horiontal line passing through the pivot center of triger axle 36. This relative location of the latching contact of the vertical surface edges of the latch elements 51 and 62 results in the contact force generated by the tension in the bowstring to be effectively applied along a line that is radially displaced from the pivot point of the trigger axle 36 and thus produces a moment arm that tends to rotate the trigger lever 22 in a couterclockwise position, thereby better assuring that the cylinder 21 and trigger lever will be maintained in latched engagement. Such a configuration is particularly advantageous in that the greater the tension in the bowstring, the greater will be the force tending to maintain these elements in latched engagement.

Formed with the main body 60 of the trigger lever at a side thereof opposite to the latch surface 62 is a lock projection 63. This lock projection 63 has a generally rectangular shape and is formed with a corner defined by a transverse edge 64 and a parallel edge 65 as referenced to the longitudinal axis of the trigger. These edges 64 and 65 are designed to cooperate with the locking lever as will be subsequently described in effecting a safetying or locking engagement. In accordance with this invention, the transverse edge 64 is formed at a small angle of the order of 10 degrees as referenced to a horizontal plane to enhance locking engagement with the locking lever as will be further described. Also formed in the lock projection 63 is a small aperture 66 which receives one of the connecting loops 41 of the torsion spring 40 in secured relationship.

Forming the locking lever 23 is a flat plate formed from structurally rigid material such as steel and which is journalled on the axle 37. It is formed generally in the shape of an elongated lever pivoted at its midpoint having one end portion thereof extending downwardly and designed to cooperatively interengage with the trigger level. This end porion designated generally by the numeral 67 is formed with an L-shaped locking recess 68. The locking recess 68 is of an angle configuration similar to the lock projection 63 and is thus capable of cooperatively interengaging with the respective edges 64 and 65 of the lock projection. This angled edge 64, as referenced to the axle 37 of the locking lever 23, thus effectively forms a cam surface which functions to pull the locking lever into locking engagement with trigger lever projection 63 when a clockwise rotational force is applied to the trigger lever. Safety is further enhanced by this angled configuration, but the angle is not so great as to interfere with release of the locking lever through observance or proper dimensional tolerances. The opposite end of the locking lever 23 is provided with an actuating knob 69 that extends upwardly through the slot 43 in the plate 29 to permit engagement by a person's thumb to effect movement of the safety or lock lever between its two positions. Also formed with this end of the lock lever is reset arm 70. Functional operation of the reset arm 70 will be explained in greater detail in conjunction with a description of the mechanism's operation. However, it will be noted at this point that the arm is of a length and extends in a direction such that it will revolve in between the side plates 46 of the string holding cylinder 21 and will be engaged by the cam surface 52.

The relative spacing of the axles 36 and 37 that support the trigger lever 22 and the lock lever 23 for rotational movement is such that these components, becuase of the interfering paths of movement, will also form a mechanical lock when disposed in mechanical interengagement as is shown in FIG. 3. It will be noted that the radial distance from the respective axles on pivots 36, 37 to the point of contact of the trigger lever 23 and the lock lever 22 total a distance greater than the distance between the axles thus resulting in the interfering path of movement. The trigger lever and lock lever thus cooperate to resist further rotational movement in a clockwise direction with respect to the trigger lever and a counterclockwise direction with respect to the locking lever. The locking lever is rotatable in the opposite direction to its unlock position as the horizontal edge surface of its locking recess 68 is only displaced in a direction away from the surface 64 of the lock projection 63 during revolution to the unlock position.

As previously indicated, the torsion spring 40 is also mechanically interconnected with the locking lever 23. This is accomplished by extending the one connecting loop 42 through an aperture 71 which extends transversely through the locking lever. The location of this aperture 71 is in spaced relationship to the axle 37 and is also disposed in predetermined relationship with respect to the axle 36 of the trigger lever. This spacing and positioning of the aperture 71 is designed to obtain the alternate biasing of the locking lever either to its unlocked position or toward its locked position. This functional relationship of the aperture's position and the interconnection of the torsion spring 40 as between the locking lever and trigger lever will be readily understood in the subsequent description of the sequential functional operation of the trigger mechanisms.

It will be noted in FIG. 3 that a forwardly facing edge surface 72 of the locking lever is cut in a predetermined configuration to provide adequate clearance for the relative rotation of the trigger lever 22. It will also be noted that a rearwardly facing edge surface 73 of the locking lever is configured and is of a dimension with respect to the axis of rotation to clear the base of the slot 43 during rotational movement. The length of that portion of the locking lever which extends in a downward direction is such that a portion of the edge surface 73 at the terminal end 67 will be revolved into contacting engagement with the interior surface of the end wall 27 when the locking lever is revolved in a clockwise direction to the unsafe or unlocked position. Thus, the spacing of the axle 37 relative to the end wall 27 must be of a predetermined dimension to enable the components to mechanically interengage and thus limit the rotational movement of the safety in a clockwise direction.

Figure 5:
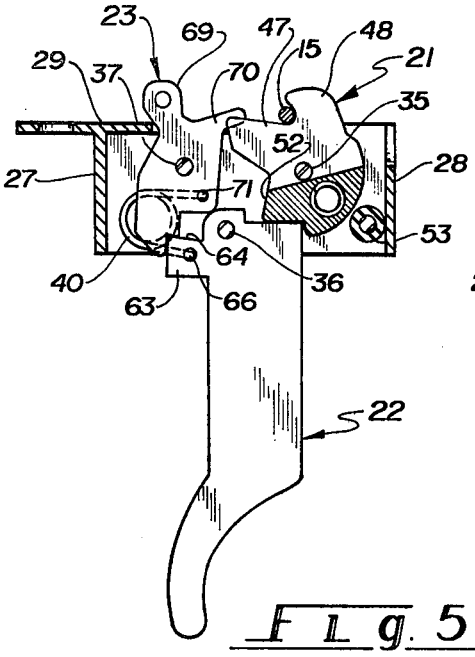
FIGS. 5–8 are diagrammatic sectional views similar to that of FIG. 3, but on a reduced scale and sequentially illustrating the functional operation of the trigger mechanism.

Functional operation of the trigger mechanism is illustrated in the sequential diagrams of FIGS. 5–8. FIG. 5 illustrates the mechanism with the components disposed in the position as illustrated in FIG. 3. In this position, the components are arranged as they would be where the string holding cylinder 21 is in engagement with and receives a bowstring 15 in the V-shaped notch 47. In this position, as is previously noted, the latching recess 51 of the cylinder is in mechanical interengagement with the latch surface 62 of the trigger lever and the cylinder is thus restrained against clockwise rotation as in the case of releasing the bowstring. With the locking lever 23 in locked engagement with the trigger lever 22, the cylinder 21 is prevented from revolving further in a counterclockwise direction and will be held in a stationary position regardless of whether a bowstring is engaged therewith. Also in this configuration, the locking lever 23 is shown positioned in proper relationship to mechanically interengage with the trigger lever 22 and prevent its rotation in a clockwise direction as would be necessary to release the cylinder and the bowstring that is secured in its notch. In the illustrated lock position, the locking lever 23 is positioned with its locking recess 68 interengaging with the lock projection 63 of the trigger lever. The angled upper transverse edge 64 of the trigger lever engages a cooperating edge of the locking lever's recess and its rotation in a clockwise direction is thus prevented as a consequence of the interfering paths of movement of the respective components as is determined by the spacing of the respective axles 36 and 37. In this position, it will also be noted that the torsion spring 40 is applying opposing forces with respect to the trigger lever and locking lever; but, since the trigger lever is prevented from rotating in a counterclockwise direction, the force is effectively applied solely against the locking lever and tends to urge that lever in a counterclockwise direction. The result is that the torsion spring is operating to maintain the locking lever in its locked engagement with the trigger lever. By appropriate location of the apertures 66 and 71 which receive the connecting loops 41 and 42 of the torsion spring, this desired rotational biasing of the locking lever can be readily achieved. Referring to FIGS. 3 and 5, it will be noted that the aperture 71 in the locking lever is disposed relatively forward referenced to a plane extending through the aperture 66 located in the trigger lever and the axle 37 of the locking lever. This arrangement thereby enables the spring 40 to effect this desired rotational movement to assure that the locking lever 23 will tend to be maintained in locked engagement with the trigger lever.

Figure 6:
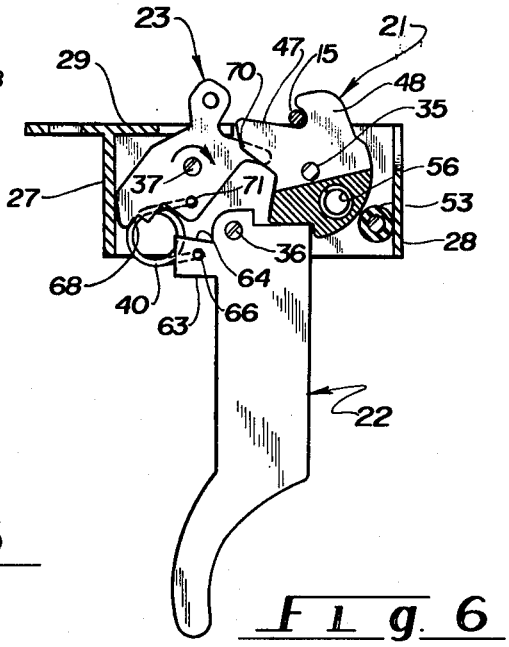

Preparatory to release of the bowstring 15 from the string holding cylinder 21, it is necessary that the locking lever 23 be manually pivotably rotated in a clockwise direction to the unlocked position as is shown in FIG. 6. The string holding cylinder 21 and trigger lever 22 remain in their cooperating position to hold the bowstring in its cocked position. With the locking lever 23 pivoted to this unlocked position, it will be noted that the reset arm 70 has been rotated forwardly with its terminal end projecting between the side plates 46 of the cylinder. Rotational movement as previously explained is limited through the contacting engagement of the rearwardly facing surface 73 of thelocking lever engaging the rear end wall 27 of the frame. In this position, it will also be noted that the aperture 71 in the locking lever 23 has been revolved to a position such that it is disposed relatively rearward of a line extending between the axle 37 and the aperture 66 formed in the trigger lever. In this position, the torsion spring 40 is thus effective in maintaining the locking lever in its extreme forwardly rotated position with the lever's edge surface in contact with the frame end wall 27 and thereby prevents inadvertent reapplication of the safety unless specifically desired by the operator through manipulation of the actuating knob 69.

Figure 7:
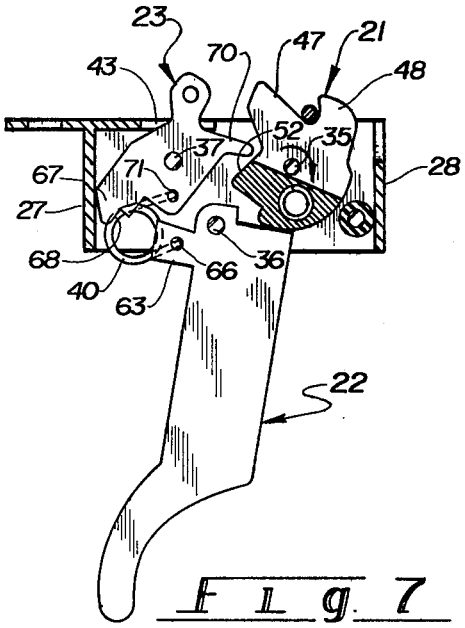

When it is desired to release the bowstring, the trigger lever 22 is rotated in a clockwise direction as is illustrated in FIG. 7 to cause the latch surface 62 to be withdrawn from the latching recess 51 and thereby permit rotation of the string holding cylinder 21 in a clockwise direction under the influence of the tension in the bowstring 15. When disengaged as shown in FIG. 7, the cam surface 50 of the cylinder will ride over the upper horizontal surface of the latch surface 62, thereby maintaining the trigger lever in its rearward releasing position. As previously noted, the cylinder 21 will revolve in a clockwise direction until either the frictional forces stop rotation or the lugs 48 come into contact with the stop element 53. This rearward movement of the trigger lever to permit release of the bowstring is enabled due to the fact that the locking recess 68 of the locking lever has been rotated to a sufficiently rearward position that it is disengaged from the lock projection 63 and that projection can be revolved in a relatively upward direction without interfering contact with the lock lever.

Figure 8:
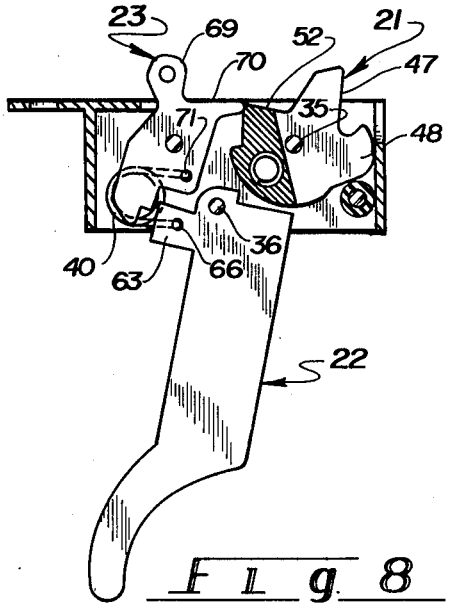

Concurrently with release of the bowstring through clockwise rotation of the cylinder 21, the cylinder will be effective in initial repositioning of the locking lever 23 so that automatic safetying of the trigger mechanism can be accomplished upon a subsequent recocking of the bowstring. This initial resetting is effected by the cylinder through the mechanical contact of its cam surface 52 with the reset arm 70. The configuration of the cam surface 52 and its relative positioning with respect to the reset arm 70 is such that when, as cylinder 21 revolves in a clockwise direction, the cam surface 52 revolved in an arc and contacts the reset arm 70 and thus causes the locking lever 23 to be revolved in a counterclockwise direction. The extent of the counterclockwise rotation of the locking lever is limited through reengagement of the forwardly facing surface 72 of a locking lever with respect to the trigger lever 22. The extent of movement, however, is sufficient to cause the aperture 71 to revolve to a position which will again be slightly forward of a line extending through the axle 37 and the aperture 66. Thus, in this position which is shown in FIG. 8, the torsion spring 40 will be effective in urging the locking lever in a continued counterclockwise rotation, although at this point, the movement is restricted through engagement of the locking lever with a corner of the trigger lever's lock projection 63.

Completion of the automatic resafetying of the trigger mechanism is accomplished by merely recocking the bowstring so as to revolve the cylinder to its string holding position or by merely revolving the cylinder to that position. This is only diagrammatically illustrated in FIG 8. through showing of a bowstring 15 being brought into contact with the one side surface of the V-shaped notch 47. Pulling the bowstring further backward will exert a force on the cylinder 21 and cause it to revolve in a counterclockwise direction. As the V-shaped notch moves upwardly and rearwardly, the string will be able to move downwardly into the notch until it reaches the vertex. As the cylinder 21 is rotated in a counterclockwise direction, its cam surface 50 will ride along the top edge of the latch surface 62 until such time as the latching recess 51 is positioned to permit the latch surface 62 to again interfit in that recess. At this point, the oppositely directed forces exerted by the torsion spring 40 will then be effective to cause rotation of the trigger lever 22 in a counterclockwise direction and result in the latch surface 62 of the trigger lever entering into the latching recess. The relative positioning of the apertures 66 and 71 in which the connecting loops of the torsion spring are connected, are located relative to each other such that with the trigger lever reengaged with the string holding cylinder, the locking lever will then be enabled to revolve further in a counterclockwise direction under the influence of the torsion spring 40 to again place the locking recess 68 into latching engagement with the trigger lever's lock projection 63 as is shown in FIG. 5.

It will be readily apparent from foregoing detailed description of an illustrative embodiment of the invention, that a particularly novel and improved trigger mechanism is provided for crossbows. This trigger mechanism incorporates the highly desirable automatically functioning safely lock mechanism that is operable solely in response to functioning of the trigger mechanism. The mechanism provided by this invention is of a very simple mechanical construction including only three pivotable lever elements and a spring biasing device. The string holding cylinder being functional during its operation in releasing of a bowstring to initiate the automatic resetting of the safety eliminates the necessity of the operator moving the safetying or locking lever or having the cocking operation result in imparting of any displacing force to complete the setting of the locking lever. A torsion spring mounted and interconnected between the locking lever and trigger lever produces biasing force to revolve the locking lever in either direction in accordance with a particular position of the trigger lever and the specific point in the operating sequence. Thus, the torsion spring either biases the locking lever into a locked position to better assure that safety is obtained, or the torsion spring biases the locking lever to an unlocked position to avoid inadvertent resetting and to maintain the locking lever in a proper position for subsequent initiation of a locking operation caused by the rotation of the string holding cylinder during a string releasing operation. The design of the mechanism is such that it is virtually impossible for the safety to be inadvertently released through mechanical jarring impact and effectively requires the operator to positively apply a force to move the locking lever to an unlocked position and enable operation of the trigger mechanism. Designing the locking projection and recess with the angled surfaces enhances the safely of the mechanism through the ability of any trigger operating force causing the locking lever to be pulled more tightly into locked engagement. Safety is also further enhanced by the configuration and location of the cylinder latch recess and trigger latch surface to result in the bowstring tension tending to force the cylinder and trigger lever into latched engagement.

Having thus described in this invention, what is claimed is:

1. A crossbow trigger mechanism for alternatively holding of a crossbow string in cocked position and release thereof comprising string holding cylinder means releasably engageable with a crossbow string and pivotably supported for rotation about its pivot axis between a first position for holding a string in cocked position when engaged therewith and a second position where a string is released from such engagement, and said string holding cylinder means being adapted to be rotated in response to movement of a crossbow string after the latter is released from its cocked position trigger lever means pivotably supported for rotation about its pivot axis between a latch position in mechanical engagement with said cylinder means for maintenance of said holding cylinder means in said first position and an unlatched position enabling said cylinder means to revolve toward said second position, locking lever means pivotably mounted on said frame for rotation about its pivot axis between a locked position in mechanical engagement with said trigger lever means to prevent rotation of said trigger lever means out of latching engagement with said cylinder means and an unlocked position permitting rotation of said trigger lever means to said unlatch position, said locking lever means, when in said unlocked position, adapted to be engaged by said cylinder means during revolution of said cylinder means to said string releasing position and rotated by said cylinder means in a direction toward the locked position of said locking lever means, and biasing means connected with said locking lever means for biasing of said locking lever means to either its locked or unlocked positions.

2. A trigger mechanism according to claim 1 wherein said biasing means is connected with said trigger lever means for biasing of said trigger lever means to its latch position with respect to said cylinder means.

3. A trigger mechanism according to claim 1 wherein said string holding cylinder means, trigger lever means and locking lever means pivot axes are disposed in parallel relationship.

4. A trigger mechanism according to claim 3 wherein said trigger lever means and locking lever means are mechanically interengageable at repsective points at radially outward distances relative to their respective pivot axes such that the sum of these radial distances is greater than the spacing of their pivot axes to cooperatively prevent mutual rotation in a direction toward said locked position further than said locked position.

5. A trigger mechanism according to claim 3 or 4 wherein said cylinder means and trigger lever means are mechanically interengageable at respective points at radially outward distances relative to their respective pivot axes such that the sum of these radial distances is greater than the spacing of their pivot axes to cooperatively prevent mutual rotation and thereby prevent revolution of said cylinder means to a string releasing position.

6. A trigger mechanism according to claim 5 wherein said biasing means includes spring means mechanically connected at respective points with each of said locking lever means and a fulcrum carried by the trigger mechanism such that said spring means point of connection with said locking lever means will be disposed at one side of a line passing through the pivot axis of said locking lever means and the point of connection of said spring with said fulcrum when said locking lever means is in its lock position and when said locking lever means is in its unlock position, said spring means point of connection with said locking lever means will be disposed at the opposite side of the aforesaid line.

7. A trigger mechanism according to claim 6 wherein said fulcrum for said one spring means point of connection is on said trigger lever means and said spring means exerts a relative force on said trigger lever means and locking lever means at their respective points of connection to bias those points in diverging relationship.

8. A trigger mechanism according to claim 7 wherein said spring means is a torsion spring.

9. A trigger mechanism according to claim 5 wherein said cylinder is formed with a latching recess for reciving a matingly configured element formed on said trigger lever.

10. A trigger mechanism according to claim 3 which includes a frame for supporting of said cylinder means, trigger lever means and locking lever means in operative relationship on said frame.

11. A trigger mechanism according to claim 10 wherein said frame includes stop means mechanically engageable with said locking lever means to prevent its revolution in a direction toward its unlocked position beyond said unlocked position where it is engageable by said cylinder means during revolution of the cylinder means to said string releasing position.

12. A trigger mechanism according to claim 10 which includes cylinder means stop means carried by said frame and cooperatively engageable with said cylinder means to prevent its revolution in releasing of a bowstring beyond a fixed predetermined point and operative to tend to retain said cylinder means in its position attained at release of a string from engagement therewith.

13. A trigger mechanism according to claim 12 wherein said cylinder means stop means includes an element carried by said frame in fixed relationship to said frame and in spaced relationship to the pivot axis of said cylinder means, said cylinder means including an element movable in a path of revolution during rotation of said cylinder means to contactingly engage said cylinder means stop means element.

14. A trigger mechanism according to claim 10 wherein said cylinder means and frame include means for cooperatively inhibiting rotation of said cylinder means and operative to tend to retain said cylinder means in its position attained at release of a string from engagement therewith.

15. A trigger mechanism according to claim 14 wherein said means for inhibiting cylinder means rotation is a relative sliding frictional contact between said cylinder means and frame.

16. A trigger mechanism according to claim 14 wherein said means for inhibiting cylinder means rotation includes biasing means carred by one of either of said frame or said cylinder means projecting into contacting engagement with the other of said frame or cylinder means and operable to exert a frictional force against the other of said frame or cylinder means.

17. A trigger mechanism according to claim 16 wherein said frame includes a surface and said biasing means includes a compression spring carried by said cylinder means and disposed to contactingly engage said frame surface and produce a sliding frictional force during revolution of said cylinder means.

18. A trigger mechanism according to claim 1 wherein said string holding cylinder means is formed with a notch opening radially outwardly thereof with respect to its pivot axis and adapted to releasably engage with a bowstring and to be rotated to said first or cocked position in response to displacement of a bowstring to said cocked position.

19. A trigger mechanism according to claim 1 wherein said locking lever has a reset arm projecting a distance radially outward with respect to its pivot axis and said cylinder means has a surface formed thereon in radially outward spaced relationship to its pivot axis for contactingly engaging with said reset arm during rotation of said cylinder means to a string releasing position when said locking lever has been first revolved to its unlock position.

20. A trigger mechanism according to claim 1 wherein said cylinder means and said trigger lever are each formed with respective cooperatively engageable latching surfaces that have a respective point of contact located a distance radially outward with respect to their respective pivot axes and configured whereby any force of contact developed at such point of contact by tension in a bowstring held by said cylinder means is directed along a line which extends between the cylinder means and trigger lever means pivot axes whereby bowstring generated forces are effective in urging and maintaining said cylinder means and trigger lever means in latched engagement.

21. A trigger mechanism according to claim 1 wherein said trigger and locking lever means are each formed with respective cooperatively engageable locking surfaces located a distance radially outward with respect to their respective pivot axes and having respective predetermined configurations that are adapted to mechanically interlock with each other when said trigger and locking lever means are in locking engagement whereby application of a force to said trigger lever means to rotate said trigger lever in a direction out of latching engagement with said cylinder means will develop a force between said trigger and locking lever means tending to urge said levers means into locking engagement.

* * * * *